US005700177A

United States Patent [19]

Lemelson

[11] Patent Number: 5,700,177

[45] Date of Patent: Dec. 23, 1997

[54] STACKED COMPONENTS ASSEMBLY TOY

[76] Inventor: Jerome H. Lemelson, Suite 286, Unit 802, 930 Tahoe Blvd., Incline Village, Nev. 89451

[21] Appl. No.: 689,228

[22] Filed: Aug. 7, 1996

[51] Int. Cl.[6] ..... A63H 03/16

[52] U.S. Cl. ..... 446/117; 446/97; 273/156

[58] Field of Search ..... 446/87, 97, 117; 273/156

[56] References Cited

U.S. PATENT DOCUMENTS

| | | | |
|---|---|---|---|
| 998,243 | 7/1911 | Gibson | 446/117 |
| 2,377,100 | 5/1945 | Patterson | 446/117 |
| 2,493,697 | 1/1950 | Raczkowski | 273/156 |
| 2,725,234 | 11/1955 | Coble et al. | 446/97 |
| 3,013,800 | 12/1961 | Zeve | 446/97 |
| 3,765,121 | 10/1973 | Vennola | 446/117 |
| 4,211,029 | 7/1980 | Cretin | 446/117 |
| 4,509,920 | 4/1985 | Kaufmann | 446/117 |
| 4,820,234 | 4/1989 | Isaf | 446/117 |

*Primary Examiner*—Max Hindenburg
*Assistant Examiner*—Jeffrey D. Carlson
*Attorney, Agent, or Firm*—J. Kevin Parker

[57] ABSTRACT

An assembly toy is provided for constructing a three-dimensional composite object as defined by the successive edges of a plurality planar members stacked upon one another in a particular order. An axial structure such as a pair of rods is mounted to a base structure and passes through holes of each of the stacked members to align the holes of each such member and thereby fix its position and orientation. The toy may be provided as a puzzle with the user left to discover the particular order of stacking which results in the predetermined composite object, or each member may be labeled to indicate its stacking order.

20 Claims, 2 Drawing Sheets

STACKED COMPONENTS ASSEMBLY TOY

BACKGROUND AND SUMMARY OF THE INVENTION

Assembly toys are construction kits made up of component articles which may be assembled by children (or playful adults) into composite objects. With some toys, the composite objects may be of more or less arbitrary shape and design according to the assembler's imagination. With other toys, the composite object constructed from the component articles is predetermined. The predetermined object is either known to the user, such as with a so-called jig-saw puzzle, or is unknown until the composite object is created. In the case of such assembly toys which result in the construction of a three-dimensional object, there ideally should exist some means for joining components together which results in a strong enough interconnection between the components to form a composite object which will not fall apart and, at the same time, allows for rapid disassembly during the trial and error process of constructing the object. It is also advantageous for cost reasons if the component parts can be easily manufactured from a suitable material by a simple process.

The present invention is an assembly toy which includes a plurality of planar components or members assemblable into a predetermined object. The planar members may be manufactured by die-cutting materials such as paper, paperboard, metal, or by injection molding plastic. In order to form the composite object, the planar members are stacked together so that the planar faces of adjacent members lie opposite one another in face-wise abutment. When the components are stacked in a particular order with each such component in a particular orientation, a three-dimensional composite object is formed as defined by the successive edges of the stacked members. One or more apertures in each component allow the passage of an axial structure which aligns the apertures in each of the stacked members to constrain the orientation of the member with respect to the axial structure. The axial structure may comprise, for example, an elongated dowel, rod, pin, or tube attached to a base or other support structure upon which the planar components are stacked. The rod and aperture may be round in which the case the stacked members are fixed translationally but are free to rotate, or another rod may be employed to pass through a second hole through each member to fix the rotational orientation of each member as well. Alternatively, the apertures of the planar members and the axial structure may by polygonally shaped in cross-section (eg., square, rectangular, or triangular) to constrain the rotational orientation of the stacked members.

Each member may be labeled, such as with a letter or number, or otherwise coded to indicate the order in which it should be stacked in order to form the object. Alternatively, the toy may be provided as a puzzle with the user left to discover the particular order of stacking which results in the predetermined composite object.

Other embodiments of the invention may include one or more notches in one or more of the planar members into which may be inserted extensions of an ornament to frictionally hold the ornament to the composite object. For example, where the composite object is a bust of a human head, such notches may be employed to hold facial features such as eyes, ears, noses, beards, etc. In order to add structural stability to the composite object, an adhesive may be used to secure the stacked members together.

It is therefore an object of the invention to provide an assembly toy having planar component parts formed from sheet material by a die-cutting or similar process.

It is a further object of the invention to provide an assembly toy having component parts which can be assembled by stacking the components to form three-dimensional composite objects defined by the edges of the stacked components.

Other objects, features, and advantages of the invention win become evident in light of the following detailed description considered in conjunction with the referenced drawings of a preferred exemplary embodiment according to the present invention.

DETAILED DESCRIPTION OF THE INVENTION

Figure 2:
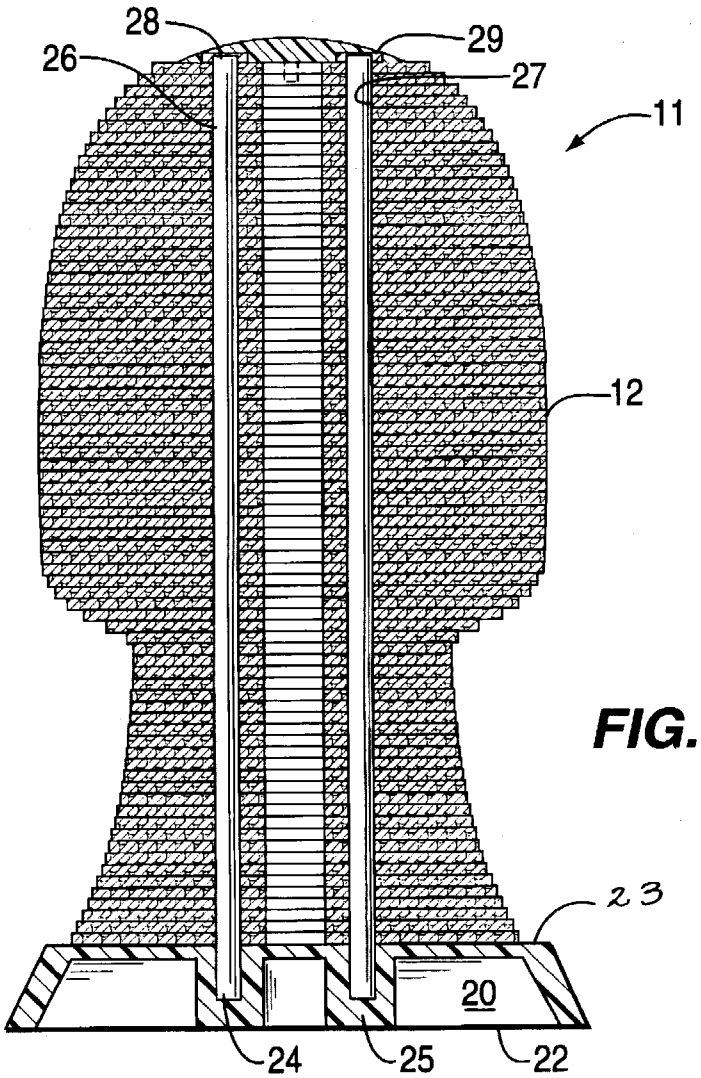
FIG. 2 is a front view of the object depicted in FIG. 1 taken in cross-section.
Figure 1:
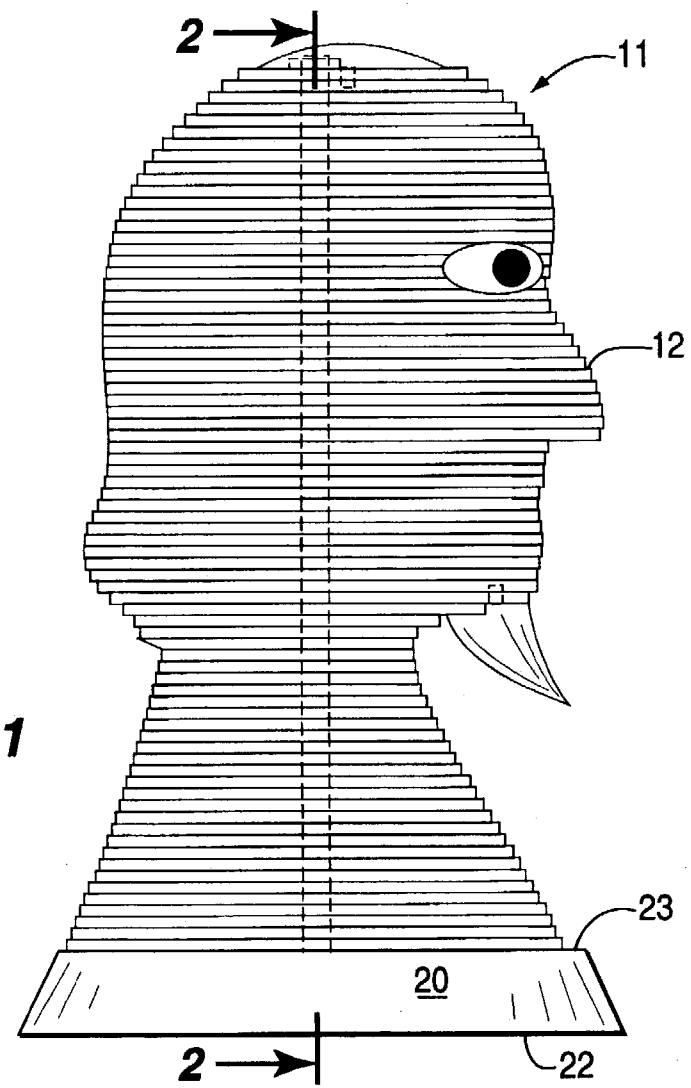
FIG. 1 is a side view of a three-dimensional composite object in the form of a bust of a human head as defined by the edges of a plurality of stacked planar members.
Figure 5:
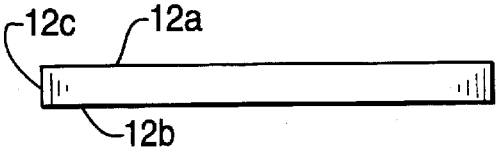
FIG. 5 is a side view of a representative planar member.

In FIGS. 1 and 2 are shown a first embodiment of the three-dimensional construction toy and puzzle comprising a composite object assembly 11 of multiple stacked planar components defining a bust of a head supported by a base 20. FIG. 1 is a side view of the toy, while FIG. 2 is a cross-sectional frontal view. The object 11 is formed of a stacked array of flat sheet-like or planar component members 12, each member 12 having opposite faces 12*a–b* and a circumscribing edge 12*c* as shown from the side in FIG. 5. When properly aligned as shown, and assembled face-to-face in a vertical stack, the stacked members define by their circumscribing edges a simulated bust of a person or other recognizable object.

The components 12 are preferably die-cut sections of cardboard (or paper or other paper products), although they may also be die-cut or stamped sections of sheet metal, or injection molded plastic. In the embodiment shown, the members 12 are annular slices or shapes, one of which is shown in plan view in FIG. 3 and in a side view in FIG. 5. The flat annular members 12 are essentially stepped slices of the bust (or other object) defined by the assembly 11. The members 12 may be formed from respective handmade drawings using the technique of descriptive geometry applied to select horizontal sheet-like sections of the object to be divided into such sheet slices or sections, or by similar techniques applied to digital computer graphics employing suitable algorithms developed for so sectioning three dimensional objects.

A number of assembly techniques may be employed to assemble and retain the members 12 in order to form the composite object assembly 11, one of which is employed in the embodiment shown in FIGS. 1 and 2. A support or base assembly 20, which may be circular or otherwise shaped, is provided for supporting the stacked members 12. The base 20 has an upper surface 23 and a flat bottom surface 22 adapted to sit on a flat surface, such as a desk, shelf or table top. It may be formed of wood or metal or molded of plastic, and may be in the range of a quarter of an inch to two inches in height and rectangular or circular in shape. The base 20 may also be shaped to represent the upper torso or the entire body (including the legs) of a person represented by the properly assembled slices or sections which torso or body may be provided in full or reduced scale with respect to the slice-assembled head 11.

In FIG. 2, two elongated parallel rods 26 and 27, (which may be elongated structures of various types such as wooden dowels, metal or plastic pins or tubes, etc.) are secured at their lower ends to cavities 24 and 25, respectively, in the base 20 and extend upwardly therefrom to form an axial structure for supporting the assembly of variably shaped planar members 12 above the flat upper surface or top 23 of the base 20. The rods 26 and 27 may be frictionally secured in holes or cavities 24 and 25 in the top wall of the base or, if the base assembly 20 is a plastic or metal molding, may be molded integral therewith.

Figure 3:
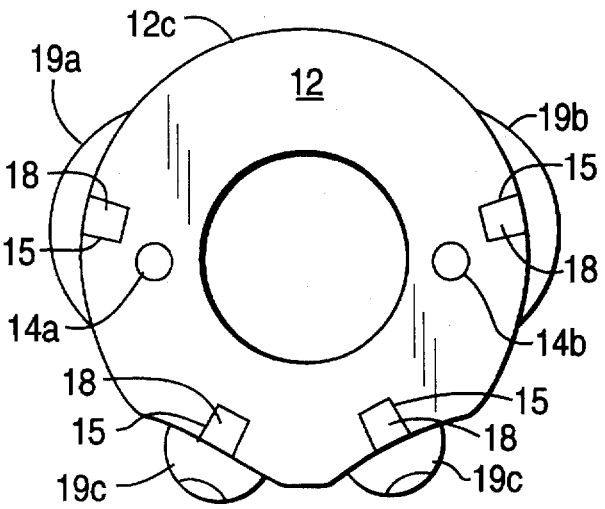
FIG. 3 is a plan view of a representative planar member used to construct the composite object.

The rods 26 and 27 also serve to simplify assembly of the puzzle or toy. As shown in FIG. 3, each planar component 12 of this embodiment has two spaced-apart round holes or apertures 14*a* and 14*b* cut, drilled or molded vertically therethrough. The holes 14*a* and 14*b* are configured and located to permit the component to be slidably (or frictionally) engaged on the parallel rods 26 and 27 to form a stacked array thereof as in FIG. 1 with the flat faces 12*a* and 12*b* of each component 12 flatly abutting the respective flat surfaces of the planar components of the assembly above and below it. The rods 26 and 27 serve to align the holes 14*a* and 14*b* and thus fix the position and orientation of each of the stacked members 12 in the array.

Also shown in FIG. 2 are cap-nuts or fasteners 28 and 29 which are frictionally secured to the upper ends of rods 26 and 27 to hold the assembly of components 12 together. If so-called cap-nuts are employed, they may be pushed onto the ends of the rods 26 and 27 after all the components 12 have been properly assembled and stacked on the rods and employed to compressively retain the stacked array of components together, as shown.

The components 12 are shown as annular configurations with the sheet material of each defining a wall for the (hollow bust or figure) assembly which varies from about a quarter of an inch to an inch or more depending on its size. The holes 14*a* and 14*b* are shown in FIG. 3 as being formed in opposite lateral portions of the annular ring-like section or slice which is the member 12. They may also be otherwise located such as along a line or axis extending from front to back of the bust or figure.

Also shown in FIG. 3 are a plurality of indentations or notches 15 formed in respective portions of the outer edges of the planar components 12 which notches may be employed to assemble die cut and/or molded components to the assembled stack of components 11. Four of such components 19*a* to 19*d* are shown in FIG. 3, and each such component has a spline, pin or tab 18 frictionally secured or held by bonding in notches 15 formed in one or more of the stacked components 12. Each of the components 19*a–d* is a semi-spherical shell molded of plastic with a central pin-like protrusion 18 which may be frictionally held in a notch 15 formed in one (or more) of edge(s) 12*c* of a planar component 12 of the assembly 11 forming the bust. Other components, such as simulated eyes, noses, mouths, eyebrows, mustaches, beards and the like may also be frictionally inserted in respective indentations or notches to complete the object assembly 11.

Figure 4:
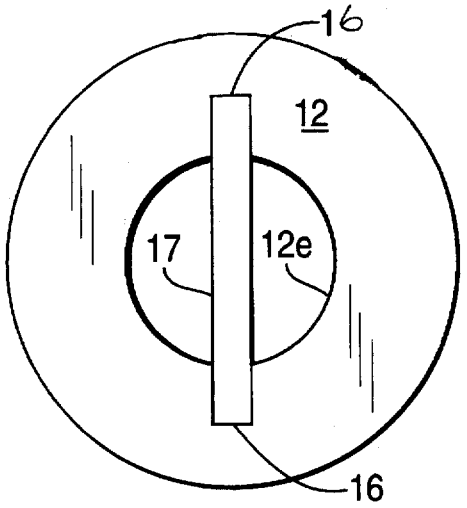
FIG. 4 is a cross-sectional plan view of a composite object showing a spline inserted through a pair of notches of an annular planar member.
Figure 6:
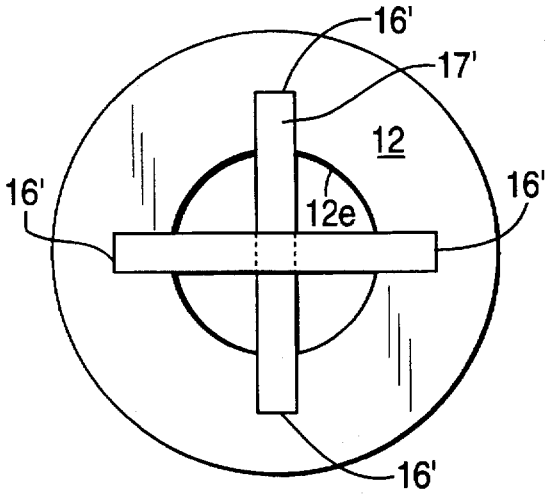
FIG. 6 is a cross-sectional plan view of a composite object showing a spline consisting of perpendicular planar sections inserted through four notches of an annular planar member.

FIG. 4 is a transverse section of the object assembly 11 which shows another embodiment employing a pair of opposing notches 16 formed in the inside edge 12*e* of a plurality of annularly shaped components 12 of a stacked array of such components assembled to form a bust, head, figure, vehicle or other object. The opposed notch formations 16 of all components become vertically aligned upon proper assembly of the puzzle and serve as an elongated channel into and between which channel a die-cut sheet component or vertically extending spline 17 may frictionally fit to hold the assembly together. In other words, in this embodiment, the axial structure for retaining the components 12 is a rectangular spline 17 which passes through an aperture of each component 12 defined by the space within the annulus together with the notches 16. The components 12 forming the bust or head may then be assembled on the spline which may be secured to a supporting base to support the assembly erect on a surface. FIG. 6 shows another embodiment in which four opposing notches 16' are formed in the inside edge 12*e* of each of planar components 12. A spline 17' consisting of two perpendicular planar sections 17'*a* and 17'*b* then forms the axial structure which passes through the notches 16'.

Figure 8:
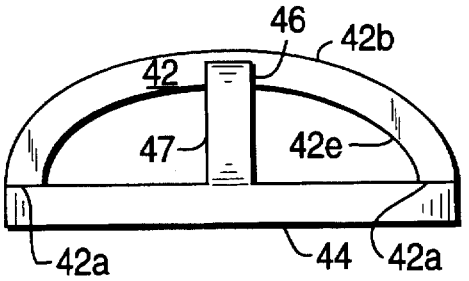
FIG. 8 is a planar view of a representative planar component of the embodiment shown in FIG. 7.
Figure 7:
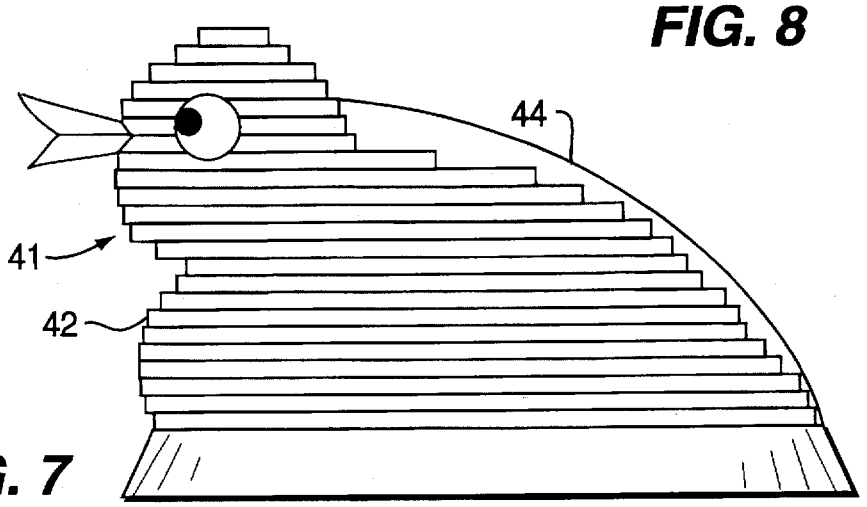
FIG. 7 is a side view of a three-dimensional composite object in the form of a bust of an animal as defined by the edges of a plurality of stacked planar members placed against a vertical panel of a supporting base.

In FIG. 7 is shown another embodiment of a toy having a back panel 44 adapted to be hung on a wall or stand up vertically and adapted to receive and retain there against an assembly 41 of stacked planar elements 42 which define, when so assembled, a portion of an object or assembly such as described above. In other words, assembly 41 is formed of a stacked array of planar sections of an object which has been cut in half or less than half wherein such sections contain half, or less than half, the areas of respective of the slice-sections 12 of the embodiment of FIGS. 1 and 2. As shown in FIG. 8, each planar member 42 of this embodiment has a straight rear edge portion 42*a* which abuts the surface of the back panel 44 and an arcuate outer peripheral edge 44*b*, a plurality of which define the contours of the object assembly 41. While the stacked object assembly 41 defined by members 42 of FIG. 7 will be solid, it may also be shell-like in structure, if, for example, it is formed of components similar to the components 12 shown in FIGS. 1–5 but cut in half (or less) along a suitable axis or plane. One or more indentations or notches 46 may be formed in the edge 42*e* to support the components assembled and aligned on one or more strips, or spurs or elongated splines 47 formed in and protruding from back panel 44. Alternatively, the assembly 42 may be supported within a suitably shaped cavity formed in the back panel 44 which is operable to retain the planar components 42 together to form a partial object or shell of a bust, figure, animal, etc. or a plurality thereof as a display.

To facilitate proper assembly of the flat sheet-like components described above, select indicia such as numbers and/or alphabetical characters may be printed on either or both faces of each component to indicate to a person making the assembly, the order in which the components are stacked, one above the other. Alternatively, the members may be left unmarked and the toy used as a puzzle with the user left to discover the correct stacking order in order to form the composite object.

Each of the planar components 12 may also be die-cut into two or more assembleable parts which may be first assembled to form the components, either on a flat surface prior to stacking or in place on top of the stack as it is assembled to form the composite object. In order to stabilize the completed structure, other embodiments may employ adhesive on the faces 12*a* and 12*b* of the planar components 12 to hold the components together after stacking.

Although the invention has been described in conjunction with the foregoing specific embodiment, many alternatives, variations, and modifications will be apparent to those of ordinary skill in the art. Such alternatives, variations, and modifications are intended to fall within the scope of the following appended claims.

What is claimed is:

1. An assembly toy comprising:

a plurality of planar members having opposite faces and a circumscribing edge, each member having at least one aperture passing therethrough;

an axial structure attached to a base and extending vertically therefrom, said axial structure being shaped to pass through the apertures of said planar members as said members are stacked upon said base in face-wise abutment to align the apertures and thereby constrain the orientation of said members;

wherein said planar members are individually shaped such that when said members are stacked upon one another; in a particular order and fixed in position and orientation by said axial structure, the circumscribing edges of the successive stacked members define a predetermined composite three-dimensional object; and further wherein two or more of said planar members have one or more notches in the circumscribing edges thereof so that said two or more planar members may be stacked and oriented to align said notches to thereby define a slot for frictionally retaining protrusions of ornamental articles to be mounted on the composite three-dimensional object.

2. An assembly toy in accordance with claim 1 wherein each of said planar members has a pair holes passing therethrough and further wherein said axial structure comprises a pair of elongated rods attached to said base and shaped for passing through said holes to thereby constrain the rotational orientation of said planar members as they are stacked thereupon.

3. An assembly toy in accordance with claim 1 wherein said axial structure and said apertures of said planar members are polygonally shaped in cross-section to thereby constrain the rotational orientation of said planar members as they are stacked said axial structure.

4. An assembly toy in accordance with claim 1 wherein said planar members are annular in shape such that a hollow composite object is formed when the members are stacked.

5. An assembly toy in accordance with claim 1 further including a plurality of ornamental articles.

6. An assembly toy in accordance with claim 5 wherein said composite object is a bust of a head and said ornamental objects are facial features.

7. An assembly toy in accordance with claim 1 wherein said planar members are labeled to indicate the order in which the members are to be stacked in order to form a predetermined composite object.

8. An assembly toy in accordance with claim 1 wherein the faces of said planar members are coated with an adhesive to secure the members together after being stacked to form the composite object.

9. An assembly toy in accordance with claim 1 comprising a base for supporting said axial structure which is secured thereto in an upright position and wherein said base includes an upright panel against which are positioned said flat portions of said planar members as said members are stacked upon said axial support.

10. An assembly toy in accordance with claim 1 wherein said planar members comprise die-cut sections of paper.

11. An assembly toy in accordance with claim 1 wherein said planar members comprise die-cut sections of cardboard.

12. An assembly toy in accordance with claim 1 wherein said planar members comprise die-cut sections of metal.

13. An assembly toy in accordance with claim 1 wherein said planar members are formed by injection molding plastic.

14. An assembly toy in accordance with claim 1 wherein said planar members comprise a plurality of sections able to be assembled into composite planar members.

15. An assembly toy comprising:

a support including an elongated rigid member and a base supporting said rigid member in a vertical direction when said base is resting on a horizontal surface;

a plurality of first components die-cut from sheet material, said components being assembleable in a stacked array on said support and arrangeable thereon to define an object, said object selected from a group of objects including figures, busts, and heads, and having a stepped outer surface configuration defined by the outer edges of said components;

wherein certain of said first components have at least one select portion thereof configured to provide an indentation, a plurality of which define a cavity in the stepped outer surface of the shape defined by the stacked first components; and second additional components of said assembly toy shaped to assemble in said cavities defined when said die-cut first components are assembled in a stacked array defining said object.

16. The assembly toy of claim 15 wherein the assembled toy is in the form of a head of a person or character.

17. The assembly toy of claim 16 wherein said additional second components define facial features of said person or character.

18. The assembly toy of claim 15 wherein said second components are formed of a sheet material of a different color than said first components.

19. The assembly toy of claim 15 wherein said second components are formed of molded plastic.

20. The assembly toy of claim 15 wherein said second components define a surface configuration for the assembled toy which protrudes outwardly beyond a plurality of layers of the stacked components defining the assembled toy.

* * * * *